United States Patent [19]

Meier

[11] 3,996,970

[45] Dec. 14, 1976

[54] ELASTIC SHUTTLE FOR LOOMS

[75] Inventor: Franz Meier, Ruti, Switzerland

[73] Assignee: Ruti Machinery Works Ltd., Ruti, Switzerland

[22] Filed: June 30, 1975

[21] Appl. No.: 591,864

[30] Foreign Application Priority Data

July 19, 1974 Switzerland ..... 9963/74

[52] U.S. Cl. ..... 139/196.1; 139/207

[51] Int. Cl.[2] ..... D03J 5/00; D03J 5/02; D03J 5/08

[58] Field of Search ..... 139/207, 206, 196 R, 139/196 A, 197

[56] References Cited

UNITED STATES PATENTS

| | | | |
|---|---|---|---|
| 3,378,043 | 4/1968 | Naul et al. | 139/196 R |
| 3,848,644 | 11/1974 | Meyering et al. | 139/207 |

FOREIGN PATENTS OR APPLICATIONS

| | | | |
|---|---|---|---|
| 2,054,844 | 5/1972 | Germany | 139/197 |
| 161,549 | 7/1933 | Switzerland | 139/196 R |
| 375,679 | 4/1964 | Switzerland | 139/207 |
| 951,180 | 3/1964 | United Kingdom | 139/207 |
| 640,200 | 7/1950 | United Kingdom | 139/207 |

*Primary Examiner*—James Kee Chi
*Attorney, Agent, or Firm*—Donald D. Denton

[57] ABSTRACT

An elastic shuttle having an elongated shuttle body which has an opening to receive a filling thread bobbin, a longitudinally extending thread groove on one outer side and a recess for the introduction of thread cutters, clamping jaws arranged on the inner sides of the opening in order to hold fast the bobbin body of a filling thread bobbin, and a parting slot or line extending from one end of the opening and which makes possible a spreading apart of the clamping jaws upon change of the bobbin.

5 Claims, 6 Drawing Figures

ELASTIC SHUTTLE FOR LOOMS

BACKGROUND OF THE INVENTION

The present invention relates to an elastic shuttle for looms having means for automatically changing the filling thread bobbins. In the known elastic bobbins of this type, the parting line for spreading apart the clamping jaws upon change of the bobbin is extended outward either on the longitudinal side of the bobbin body facing away from the thread groove or on the one picker striking surface on the outside so that in both of these cases, upon the operation of the loom, the force which is suddenly exterted by the picker on the shuttle acts primarily on that side wall of the suttle body which is weakened by the thread groove and the recess for the introduction of thread cutter and customarily also is of smaller height than the opposite side wall. As a result of this, the danger of the breaking of the shuttle is relatively great. This has an even greater effect in the case of high speed looms.

SUMMARY OF THE INVENTION

It is an object of the present invention to produce an elastic shuttle of the aforementioned type which does not have the disadvantages described, i.e. has a longer life when used on a high speed loom.

This object is achieved in the case of elastic shuttles in accordance with the invention in the manner that the parting slot or line is conducted outward on the longitudinal side of the shuttle body which has the thread groove and the recess for the entrance of thread cutters.

With this development of the elastic shuttle, upon the operation of the loom, the force which is exerted by the picker on the body of the shuttle acts primarily on that side wall of the shuttle body which has neither a thread groove nor recesses required by the weaving process and furthermore customarily has a greater height and thus a larger cross-section. In this way the danger of a shuttle breaking is greatly reduced and the life of the shuttle is extended. By the discovery of this surprisingly effective solution there has been overcome a long existing bias on the part of the man skilled in the art who previously was of the opinion that the mouth of a parting line extending outwards on the longitudinal side of the shuttle body having the thread groove could have a detrimental effect on the weaving since warp threads could catch on the mouth of the parting line upon the introduction of the filling thread. Tests carried out in practice with the elastic shuttles produced in accordance with this invention have shown that this is not so and that the previous fears of the man skilled in the art are unfounded.

The elastic shuttle can advantageously be made in the manner that the parting line has a portion which extends from the opening for the reception of a filling thread bobbin and extends in the longitudinal direction of the body of the shuttle, and an outward opening portion which extends at an angle of between about 45° and about 75° to the longitudinal direction of the shuttle body, an angle of about 60° being preferred.

In one suitable further development, the parting line from its portion extending in the longitudinal direction of the shuttle body to the outward opening portion extends along a circular arc, the center of curvature of which is at least approximately on the outer face of the shuttle body which has the thread groove and the recess for the thread cutter. In this construction, the parting line has a continuous course.

BRIEF DESCRIPTION OF THE DRAWINGS

Further objects and advantages of embodiments of the invention will become evident from the following description and claims and from the accompanying drawings in which embodiments of the invention are shown purely by way of example. In the drawings:

DESCRIPTION OF PREFERRED EMBODIMENTS

Figure 1:
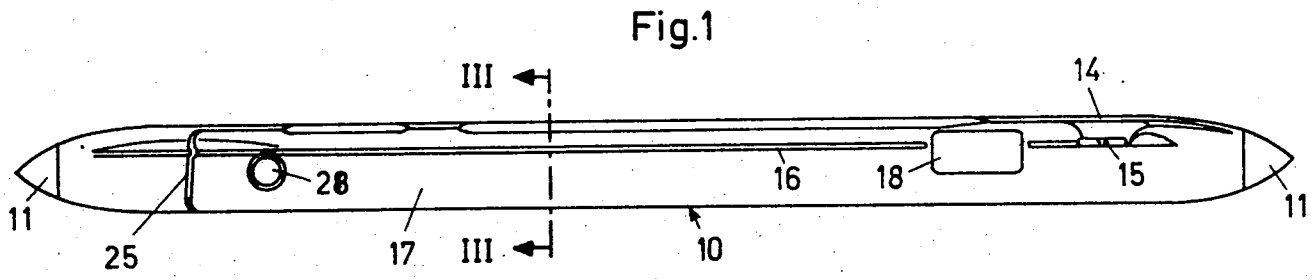
FIG. 1 shows a view in elevation looking at the longitudinal side provided with a thread groove, of an elastic shuttle developed in accordance with the invention.
Figure 2:
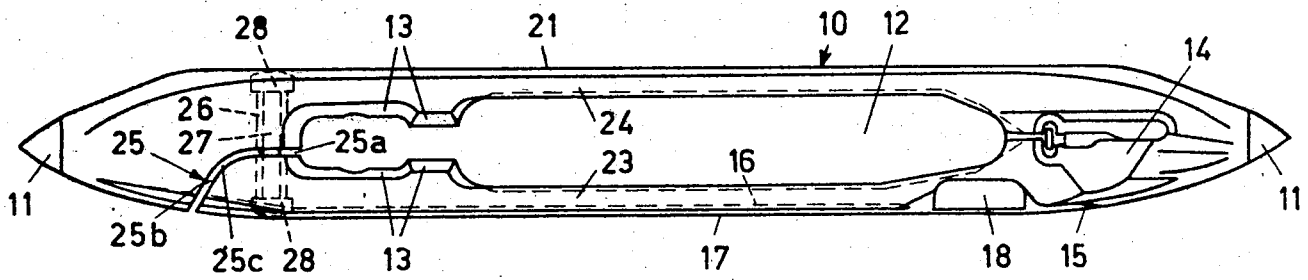
FIG. 2 is a top view of a shuttle shown in FIG. 1.
Figure 3:
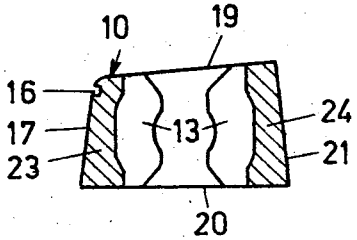
FIG. 3 is a cross-sectional view along the line III—III of FIG. 1 on a larger scale.

The shuttle shown in FIGS. 1 through 3 has an elongated shuttle body 10 preferably made of wood which is tapered at its two end portions and is provided at each end with a substantially conical metal tip 11. Within the shuttle body 10 there is provided a slot-like, longitudinally extending operning 12 adapted to receive a filling thread bobbin. The inner sides of the opening 12 have clamping jaws 13 to hold fast the bobbin body of a filling thread bobbin. The clamping jaws 13 are arranged adjacent the one end of the opening 12. At the other end of the opening 12 a threader 14 is inserted into the shuttle body 10. By means of the threader 14 the filling thread withdrawn from the tope end of the filling thread bobbin is extended through a shuttle eye 15 laterally out of the shuttle. A thread groove 16 extending in the longitudinal direction of the shuttle body 10 is recessed in that longitudinal side 17 of the shuttle body 10 on which the shuttle eye 15 is located. The thread groove 16 extends from the shuttle eye 15 to close to the opposite end of the shuttle body 10. The thread groove 16 is interrupted by a recess 18 which is located in the vicinity of the shuttle eye and is also incorporated in the longitudinal side 17 of the shuttle body for the entrance of a thread cutter, a so-called external cutter of the loom.

The cross-sectional view of FIG. 3 shows that the top 19 of the shuttle body 10 is so inclined with respect to the base surface 20 thereof that the height of the longitudinal side 17 of the shuttle body which has the thread groove 16 and the recess 18 is less than the height of the opposite longitudinal side 21. This cross-sectional shape of the shuttle body 10 is caused by the course of the warp threads when the shed is open. The lower longitudinal side 17 having the thread groove 16 and the recess 18 faces the filling thread beating-up place while the opposite higher longitudinal side 21 faces the reed. This development has the result that the side wall 23 of the opening 12 which is in any event weakened by the thread groove 16 and the recess 18 has a definitely smaller cross-sectional area than the opposite side wall 24.

In order to make possible a spreading of the clamping jaws 13 upon the automatic change of the filling thread bobbin, the shuttle body 10 is provided with a parting line 25 which extends from the end of the opening 12 adjoining the clamping jaws 13 and is extended outward on the longitudinal side 17 of the shuttle body 10 which has the thread grooves 16 and the recess 18. The parting line 25 has a portion 25*a* extending in the longitudinal direction of the shuttle body 10 which proceeds from the opening 12 and a portion 25*b* which is inclined at an angle of about 60° with respect to the longitudinal direction of the shuttle body and is guided to the outside on the side surface 17. Between the said linearly extending portions 25*a* and 25*b*, the parting line 25 has a curved portion 25*c* which extends along a circular arc whose center of curvature lies approximately on the longitudinal side 17 of the shuttle body. The parting line 25 thus extends continuously, i.e. without any sudden sharp changes in direction, from the opening 12 to the outside. The outer mouth of the parting line 25 is located on the one tapered end portion of the shuttle body 10. In the region of the portion 25*a* of the parting line which extends in the longitudinal direction of the shuttle body 10 the shuttle body is provided with a transverse bore 26 in which means 27 are arranged for the elastically resilient holding together of the arms of the shuttle body separated from each other by the parting line 25 and thus of the clamping jaws 13. The means 27 can comprise, for instance, a rubber band or at least one coil spring which acts on anchoring heads 28 arranged countersunk in the shuttle body 10.

The shuttle described differs from known embodiments essentially by the fact that the parting line 25 is guided outwards on the longitudinal side 17 of the shuttle body which has the thread groove 16 and the recess 18 and not on the opposite longitudinal side 21. From this the advantage is obtained for the shuttle described that upon the entrance of the filling thread the force suddenly exerted by the picker in particular on the left-hand tip 11 as seen in FIGS. 1 and 2 acts primarily on the side wall 24, having the greater cross-sectional area and thus a greater strength, and that the parting line 25 holds the weaker side wall 23 predominantly free of the impact load. Thus the danger of the occurrence of broken shuttles is reduced and the life of the shuttle is considerably increased even when it is used on high speed looms.

Figure 4:
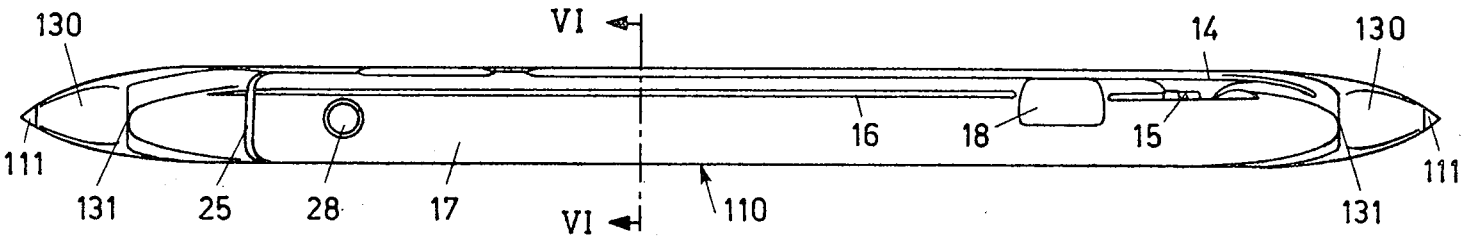
FIG. 4 is a view in elevation of another embodiment of a shuttle developed in accordance with the invention
Figure 5:
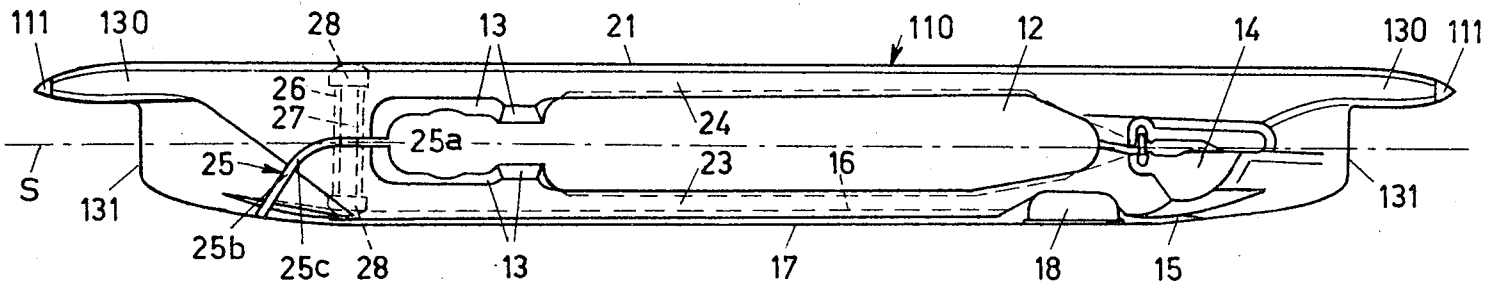
FIG. 5 is a top view of the shuttle shown in FIG. 4.
Figure 6:
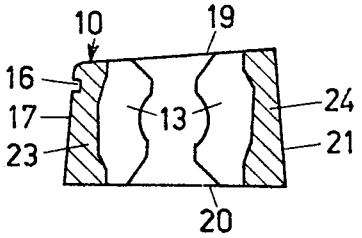
FIG. 6 is a cross-sectional view along the line IV—IV of FIG. 4, on a larger scale.

The second embodiment shown in FIGS. 4 to 6 differs from the one described above merely by a different development of the end portions of the shuttle body designated 110. As can be noted in particular from FIG. 5, the end portions 130, which are each provided with a tip 111, are arranged staggered laterally from the axis of longitudinal symmetry S of the opening 12. On the other hand there are arranged symmetrical to the axis S two flat picker striking surfaces 131 which are set back with respect to the tips 111. The rest of the development of the shuttle of FIGS. 4 to 6, is fundamentally the same as in the case of the first embodiment, for which reason the same reference numbers are used in FIGS. 4 through 6 as used in FIGS. 1 through 3 in so far as the parts and elements are the same. In the second embodiment, the parting line 25 extending from one end of the opening 12 for the reception of a filling thread bobbin is also guided outward on the longitudinal side 17 having the thread groove 16 and the recess for the entrance of a thread cutter, the parting line 25 having approximately the same course as in the case of the first embodiment. The advantages of the second embodiment are also the same as those described with reference to the first embodiment.

It is clear that the parting line 25 need not in all cases have the course shown in FIGS. 2 and 5. Thus the outward extending portion 25b instead of being inclined at an angle of about 60° to the longitudinal direction of the shuttle body can also be inclined thereto at a smaller or larger angle within the range of from about 45° to about 75°. On the other hand, it is of essential importance that the parting line 25 be extended outward on the longitudinal side 17 of the shuttle body which has the thread groove 16 and the recess 18.

It will be appreciated that various changes and modifications may be made within the skill of the art without departing from the spirit and scope of the invention illustrated, described, and claimed herein.

What is claimed is:

1. Elastic shuttle for looms with automatic changing of the filling thread bobbins, said elastic shuttle having an elongated shuttle body which has an opening for the reception of a filling thread bobbin, said opening being disposed between a front and a rear longitudinal side of the shuttle body, a longitudinally extending thread groove and a recess for a thread cutter provided on said front longitudinal side of the shuttle body, clamping jaws on the inner sides and at one end of said opening to hold the bobbin body of a filling thread bobbin fast in said opening, which makes possible the spreading apart of the clamping jaws upon the change of the bobbin, the parting slot extending outward to the front longitudinal side of the shuttle body which has the thread groove and the recess for the thread cutter.

2. The elastic shuttle according to claim 1 in which the parting slot has a portion proceeding from the recess that receives the filling thread bobbin and extending in the longitudinal direction of the shuttle body and an outward opening portion which extends at an angle of between about 45° and about 75° to the longitudinal axis of the shuttle body.

3. The elastic shuttle according to claim 2 in which the parting slot extends from the portion extending in the longitudinal direction of the shuttle body to the outward opening portion along a circular arc whose center of curvature is at least approximately on the outer surface of the side of the shuttle body which has the thread groove and the recess for the thread cutter.

4. The elastic shuttle according to claim 2 in which the outward discharging portion of the parting slot extends at an angle of at least approximately 60 to the longitudinal direction of the shuttle body.

5. The elastic shuttle according to claim 3 in which the outward discharging portion of the parting slot extends at an angle of at least approximately 60° to the longitudinal direction of the shuttle body.

* * * * *